United States Patent [19]

Bendorf

[11] 4,145,180

[45] Mar. 20, 1979

[54] IGNITION SYSTEM FOR FUEL BURNING APPARATUS

[75] Inventor: Dwaine L. Bendorf, Roswell, N. Mex.

[73] Assignee: Essex Group, Inc., Fort Wayne, Ind.

[21] Appl. No.: 855,577

[22] Filed: Nov. 29, 1977

[51] Int. Cl.[2] ..... F23Q 9/14

[52] U.S. Cl. ..... 431/46; 431/71; 431/74; 431/78

[58] Field of Search ..... 431/25, 46, 71, 74, 431/78

[56] References Cited

U.S. PATENT DOCUMENTS

| | | | |
|---|---|---|---|
| 3,514,240 | 5/1970 | Potts | 431/31 |
| 3,853,455 | 12/1974 | Riordan et al. | 431/80 |
| 4,019,854 | 4/1977 | Carlson et al. | 431/78 |

*Primary Examiner*—Carroll B. Dority, Jr.
*Attorney, Agent, or Firm*—Lawrence E. Freiburger; Robert D. Sommer

[57] ABSTRACT

An ignition system is disclosed which controls an electrically operated fuel valve and a spark generating apparatus to cause the fuel to be ignited at a fuel burning apparatus. The system also includes a flame sensing means which inhibits operation of an oscillator a predetermined time interval after operation is initiated in the event a flame at the fuel burning apparatus is not detected by the flame sensing means. The output of the oscillator is applied to a voltage converter which, in turn, controls valve actuation and spark generation. The invention can be used to light either a main burner directly, or indirectly through a pilot burner.

9 Claims, 3 Drawing Figures

IGNITION SYSTEM FOR FUEL BURNING APPARATUS

BACKGROUND OF THE INVENTION

There are many different types of fuel ignition systems known in the prior art. One type of system which has become popular employs a pair of spark electrodes which create a spark to ignite fuel issuing from a fuel burner. Fuel flow to the burner is controlled by an electrically operated valve, and generally, the rectifying property of a flame is used to detect the presence of a flame at a burner.

As shown in U.S. Pat. No. 4,019,854, it is known to employ a multivibrator in such systems and, in particular, to apply the multivibrator output to a voltage converter, the output of which is applied to the spark generator and gas valve. In the arrangement shown in this patent, a gate controls the multivibrator. A timing capacitor is charged to actuate the gate so as to initiate operation of the multivibrator. If a signal from a flame sensing circuit is not received within a predetermined amount of time, the gate is deenergized to deenergize the multivibrator.

Another device which employs a multivibrator to control a voltage converter which, in turn, controls the spark generator and the gas valve is shown in U.S. Pat. No. 3,853,455. It will be seen that a charge built upon a capacitor is used to initiate operation of a multivibrator. In the event a flame sensing circuit supplies power to the multivibrator before the charge on the timing capacitor dissipates, the multivibrator continues operating. If, however, no flame appears before the charge on the capacitor dissipates, the multivibrator is prevented from operating further.

Another patent disclosing the idea of an oscillator controlling the spark and fuel valve is U.S. Pat. No. 3,514,240. The device disclosed in this patent also utilizes a safety timer lock-out circuit comprising a timing network and a transistor to deenergize the oscillator circuit if a flame has not been detected at the main burner.

One of the problems associated with prior art devices has been sensing small current which flows through the flame so as to "prove" ignition. Due to the small magnitude of the flame sensing current in the prior art, it has generally been necessary to provide some sort of amplification in order to properly sense the current. The additional amplification adds to the complexity of the control circuitry and increases the chance of a failure.

SUMMARY OF THE INVENTION

It is thus an object of this invention to provide an ignition system for a fuel burning apparatus which is simple, troublefree, reliable in operation, and which obviates the problems associated with prior art devices.

This object as well as others which will become apparent as the description proceeds are accomplished by utilizing an astable multivibrator in an ignition control circuit which is comprised of at least one logic gate having a high impedance inhibit input. By using a gate with a high impedance input, the need for additional amplifier(s) is eliminated, thus inherently simplifying the design of the ignition control circuit. The inhibit input to the oscillator is normally held at a positive voltage level which is sufficient to prevent oscillation. However, when oscillation is to be initiated, the inhibit input is connected to ground through a discharged capacitor which forms a lock-out time control function. A flame sensing circuit is also connected to the inhibit input in such a manner that the oscillator input is held close to ground potential if a flame is sensed so as to maintain oscillation. In the event a flame is not sensed, the lock-out time control capacitor charges after a predetermined time interval to a voltage level sufficient to inhibit oscillation. The oscillator output is applied to a voltage converter which controls valve actuation and spark generation in a conventional manner.

BRIEF DESCRIPTION OF THE DRAWINGS

During the course of the detailed description of the invention, reference will be made to the drawings in which.

DETAILED DESCRIPTION OF THE INVENTION

Figure 1:
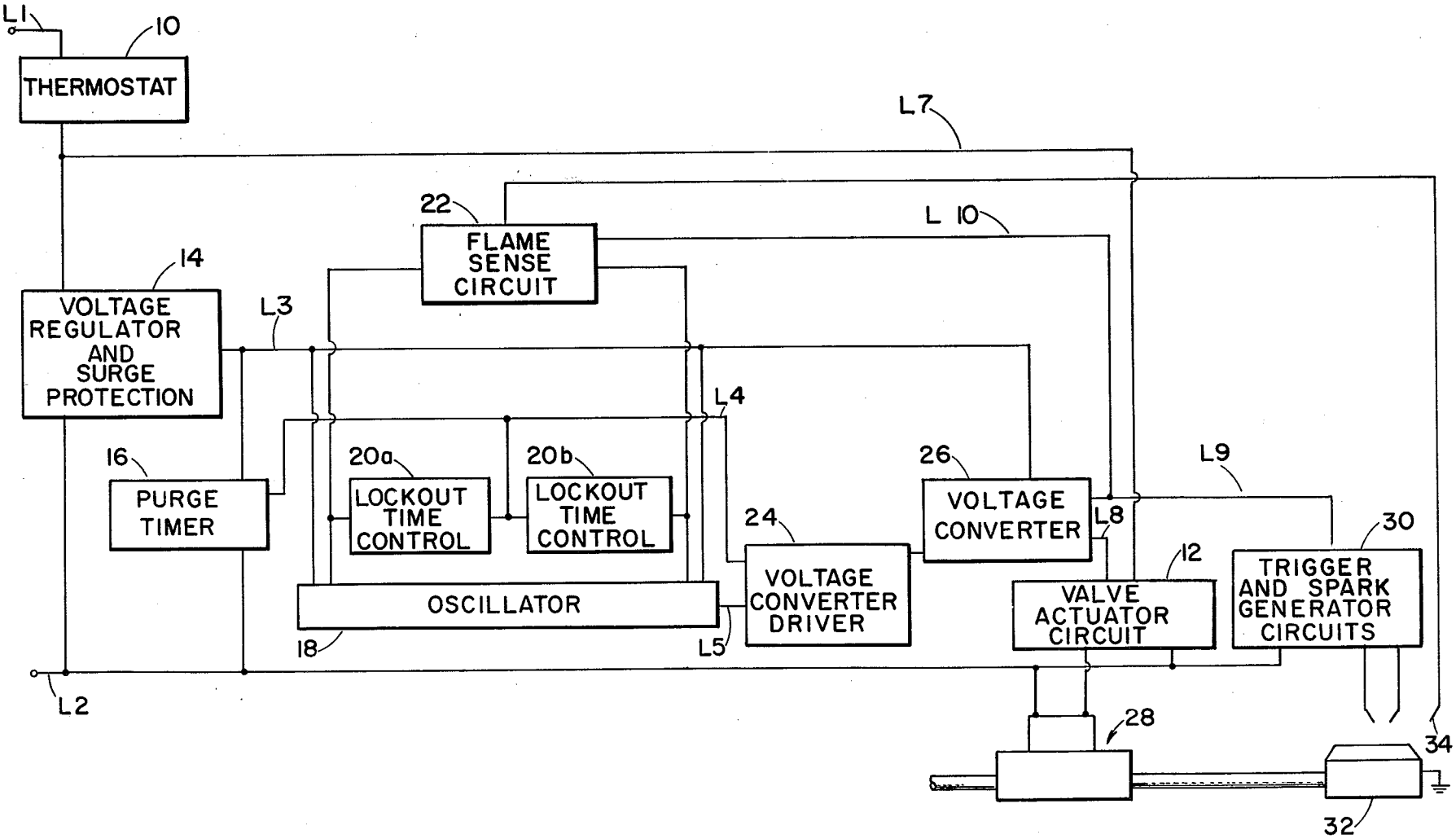
FIG. 1 is a block diagram of a direct ignition system in accordance with the present invention.

Referring now to FIG. 1, the ignition system is adapted to be connected to a suitable power source by conventional methods at lines L1 and L2. The power source may be a 24 volt AC source such as is commonly employed in furnace control circuits and the like, or it may be a 12 volt DC source such as is encountered in recreational vehicles, campers and the like. A normally open, single pole single throw thermostat 10 is connected to L1 such that it controls current flow to a valve actuation circuit 12 and a voltage regulator and surge protection circuit 14 which supplies regulated power between lines L3 and L2. Connected between lines L3 and L2 is a purge timer 16 which serves to provide a time delay between thermostat closure and spark actuation during which fuel is purged from the burner area. As it will hereinafter be seen, the purge timer is old in the art.

An astable oscillator circuit 18 providing low frequency output pulses is connected at two points to line L3 and at two points to a pair of lock-out time control circuits **20*a* and 20*b* and a flame sense circuit 22. The flame sense circuit 22 is essentially a bypass circuit which precludes charging of lock-out time control circuits when a flame is established. The oscillator circuit 18 is comprised of logic gates as will hereinafter be described in connection with FIG. 2 and because it is conventional not to show the power supply and ground connections for such components, they have not been shown in FIGS. 1 and 2. The output of the purge timer on line L4 is applied to the lock-out time control circuits 20*a*, 20*b* and to a voltage converter driver 24 along with the oscillator output on line L5. The voltage converter driver 24 is essentially a switching circuit, enabled by the purge timer and supplying an output switching signal on line L6 to cause a voltage converter circuit 26 to produce AC voltages at its output. A first AC voltage on line L8 at the voltage converter output is applied to the valve actuation circuit 12 which serves to connect the electrical operator of an electrically operated fuel valve 28 across lines L1 and L2 via line L7 and thermostat 10. The second AC output voltage from voltage converter 26 is applied on line L9 to a trigger and spark generating circuit 30** having a pair of output electrodes arranged in close proximity to a fuel burner 32 arranged to burn fuel supplied to it from valve 28. In addition, the second AC output voltage from voltage converter 26 is applied on line L10 to the flame sensing circuit 22 which senses a flame at burner 32 as a result of the flame rectified current flowing from the flame sensing circuit 22 to flame rod 34 which is situated in the flame, through the flame, and to ground. It will be seen that the flame sensing circuit essentially holds the inhibit input to the oscillator near ground level if a flame is sensed to maintain the oscillating condition of the oscillator. However, if a flame does not occur the lock-out time control brings the inhibit input to a voltage level which is sufficient to prevent oscillator oscillation so as to deenergize the voltage converter.

Figure 2:
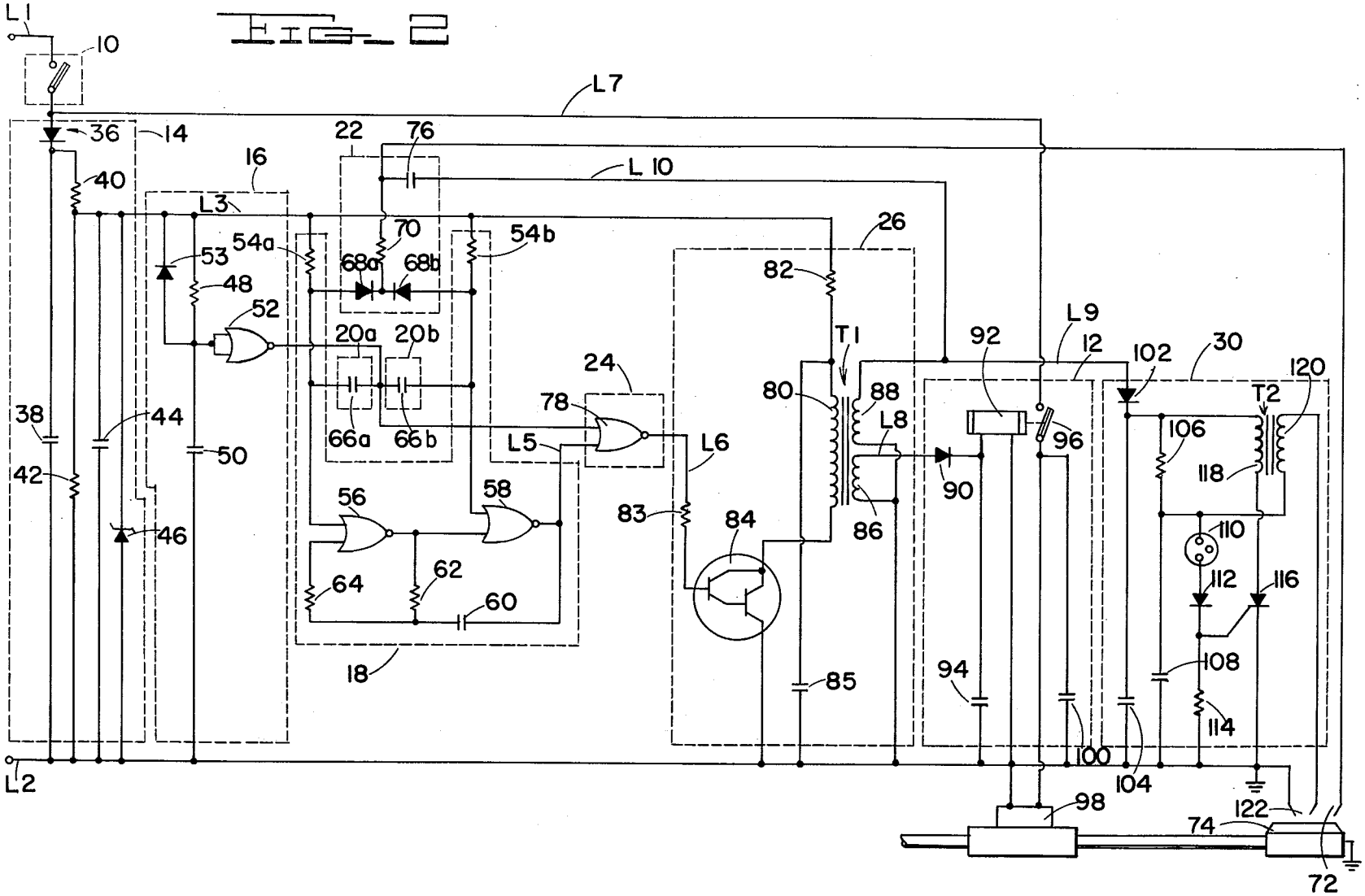
FIG. 2 is a detailed schematic of the system shown in FIG. 1.

Reference will now be made to FIG. 2 for a more thorough discussion of the various components of the system described in FIG. 1. More specifically, the voltage regulation and surge protection circuit 14 may include a solid state diode 36 having its anode connected to line L7 and located in series with a filter capacitor 38. A voltage divider network consisting of resistors 40 and 42 is connected across capacitor 38 with line L3 connected to the junction of resistors 40 and 42. An additional filter capacitor 44 and voltage stabilizing zener diode 46 are connected in parallel with resistor 42 to insure that line L3 is held at a substantially constant voltage level.

The purge timer 16 preferably is controlled by a timing network comprised of a resistor 48 and a capacitor 50 connected in series across lines L3 and L2. A NOR gate 52 having both inputs connected to the junction of resistor 48 and capacitor 50 and its output connected to the junction of lock-out time control circuits 20*a* and 20*b* responds to the timing network such that its output on L4 is normally high and switches to a low condition when capacitor 50 accumulates a sufficient charge. A solid state diode 53 is connected across resistor 48 to provide a discharge path for capacitor 50 whenever power is removed from the system.

Preferably, the astable oscillator circuit 18 includes a pair of input resistors 54*a* and 54*b* each connected to L3 and leading to an input of a pair of NOR gates 56 and 58 respectively. The output of NOR gate 56 is coupled to the other input of gate 58, the output of which is applied to line L5. A timing circuit which is effective to cause the oscillating condition is comprised of a capacitor 60 responsive to the output of NOR gate 58, a resistor 62 connected between the output of gate 56 and the capacitor 60, and a resistor 64 connected between the second input to gate 56 and the junction of resistor 62 and capacitor 60. The values of resistors 54*a* and 54*b* are chosen so that the voltage at the inputs to gates 56 and 58 is substantially equal to the output voltage of gate 52 for reasons which will hereinafter become apparent. It will be noted that whenever the inputs to gates 56 and 58 are switched to near ground potential, the oscillator circuit 18 will begin to oscillate at a frequency which is determined by the relative values of capacitor 60 and resistor 62.

Each of the lock-out time control circuits is comprised of a single capacitor (66*a* and 66*b* respectively) which is connected between the output of gate 52 and the input of gate 56 and 58, respectively. It will thus be seen that whenever the output of gate 52 is high, capacitors 66*a* and 66*b* will essentially be discharged because there will be very little voltage difference across them. However, when the output of gate 52 is switched to near ground potential, the inputs to gates 56 and 58 will be near ground potential also due to the discharged state of capacitors 66*a* and 66*b*, so as to cause the oscillator circuit 18 to oscillate. The lock-out time control capacitors 66*a* and 66*b* will immediately begin to accumulate a charge, however, and unless the flame sensing circuit 22 acts to hold the input to gates 56 and 58 at near ground level, the oscillator will cease to oscillate when a sufficient charge is built up on lock-out time control capacitors.

In accordance with the present invention, the flame sensing circuit 22 includes a pair of solid state diodes 68*a* and 68*b* each having its anode connected to the input of gate 56 or 58 respectively and their cathodes connected together. A resistor 70 is connected between the junction of diodes 68*a* and 68*b* and a flame sensing rod 72 which is situated to be enveloped by the flame at burner 74. As is well known in the art, the flame acts as an electrical conductor so that the junction of diodes 68*a* and 68*b* is brought to near ground potential when a flame is present at burner 74. Thus, whenever a flame is present at burner 74 the inhibit inputs to gates 56 and 58 will be held to near ground potential to insure that the oscillator continues to oscillate after a flame is detected. A capacitor 76, connected between L10 and the flame sensing rod 72 acts as a filter for the flame sensing circuit.

As will be seen in the drawing, the output of the purge timer on line L4 and the output of the oscillator on line L5 are applied to the voltage converter driver 24 which comprises a NOR gate 78, which provides a high output on line L6 when lines L4 and L5 are near ground potential. Thus, the output on line L6 consists of a pulse train whenever the oscillator is oscillating and is near ground potential when it is not.

The voltage converter circuit 26 consists of a conventional transformer T1 of the type normally employed in such control circuits and having a primary winding 80 connected in series with a resistor 82 and a gated solid state switching device 84 situated to be gated by the signal on line L6. In addition, the transformer T1 has a pair of secondary windings 86 and 88 which are situated to each provide a different output voltage, one for the valve actuation circuit 12 and the other for a spark generation and trigger circuit 30. The valve actuation circuit 12 is situated in circuit with secondary winding 86 and has a solid state diode 90 having its anode connected to line L8, a relay coil 92 connected to the cathode of diode 90 and to line L2, and a capacitor 94 connected between the cathode of diode 90 and L2. The valve actuation circuit further includes a normally open single pole single throw electrical contact 96 controlled by relay coil 92 connected to line L7, and an electrically operated valve actuator 98 which is then connected to line L2. Capacitor 100 in parallel with electrically operated valve actuator 98 acts as a smoothing capacitor.

Spark generating and trigger circuit 30 is connected in circuit with secondary winding 88 and is substantially conventional in design. It should therefore suffice to say that it includes a solid state diode 102, a timing network comprising capacitor 104, resistor 106 and capacitor 108. In addition, the spark generating and trigger circuit includes a voltage breakdown device 110 such as a neon tube in series with a diode 112 and a resistor 114 connected in parallel with trigger capacitor 108. The gate of an SCR 116 is connected intermediate diode 112 and resistor 114 such that it is rendered conductive in response to breakdown of neon tube 110. Located in series with SCR 116 is the primary winding 118 of high voltage transformer T2 which has a secondary winding connected in circuit with a pair of conventional spark electrodes 122 arranged to ignite fuel issuing from burner 74.

Now that the circuit of FIG. 2 has been described in detail, its operation will be briefly described. First, it will be assumed the circuit is in the off condition. Under such conditions, thermostat 10 will be open and the output gate 52 will be high so as to maintain the oscillator in the non-oscillating condition. Thus, voltage converter 26 will be deenergized to prevent energization of electrical valve operator 98 and spark discharge electrodes 122. When the thermostat closes, however, the purge timer 16 will cause line L4 to go to ground so as to initiate operation of oscillator 18. The oscillator's output will drive the voltage conversion circuit which will actuate valve actuation circuit 12 and spark generation and trigger circuit 30 to open the electrically operated valve and cause sparks to occur at the spark generating electrodes 122. After a flame has been generated at the burner 74, the inhibit input to gates 56 and 58 will each be held near ground potential so as to maintain the oscillating condition of the oscillator as a result of the conductive path to ground through the flame electrode 72 and the flame. In addition, the spark electrodes will be shorted by the flame to discharge trigger capacitor 108 through the secondary winding 120 of high voltage transformer T2 so as to deenergize the sparking circuit. In the event, however, a spark is not generated or a flame is not ignited, the lock-out time control capacitors **66*a* and 66*b* will accumulate a sufficient charge and cause the inhibit inputs to gates 56 and 58** to be at a sufficiently high enough level to prevent oscillation so as to deenergize the valve actuation and spark generation and trigger circuits.

It will be appreciated that the circuit of FIG. 2 utilizes a number of conventional components, but that the use of an oscillator circuit having at least one gate with a high input impedance is one of the novel aspects of this invention. It will further be appreciated by those skilled in the art that the high input impedance NOR gates can be implemented with CMOS technology. Another novel aspect of the circuit of FIG. 2 lies in the interaction between the oscillator, lock-out time control circuits and the flame sensing circuit. It will also be noted by those skilled in the art that in the circuit of FIG. 2 resistors **54*a* and 54*b* are redundant as well as capacitors 66*a* and 66*b* and diodes 68*a* and 68*b***. These components have been redundantly designed for the degree of safety necessary for this type of system.

The inventive concepts embodied in the system shown in FIGS. 1 and 2 are applied to a system in which direct ignition of the main burner takes place. If desired, the inventive concepts may be applied to a pilot relight type system as well. Such a system is shown in FIG. 3 and is, in general, the same as the direct light system of FIGS. 1 and 2 with the additional provision of an additional electrically operated valve and associated valve actuation circuitry operated by a second voltage converter which responds to the oscillator output and a signal from the flame sensing circuit.

Figure 3:
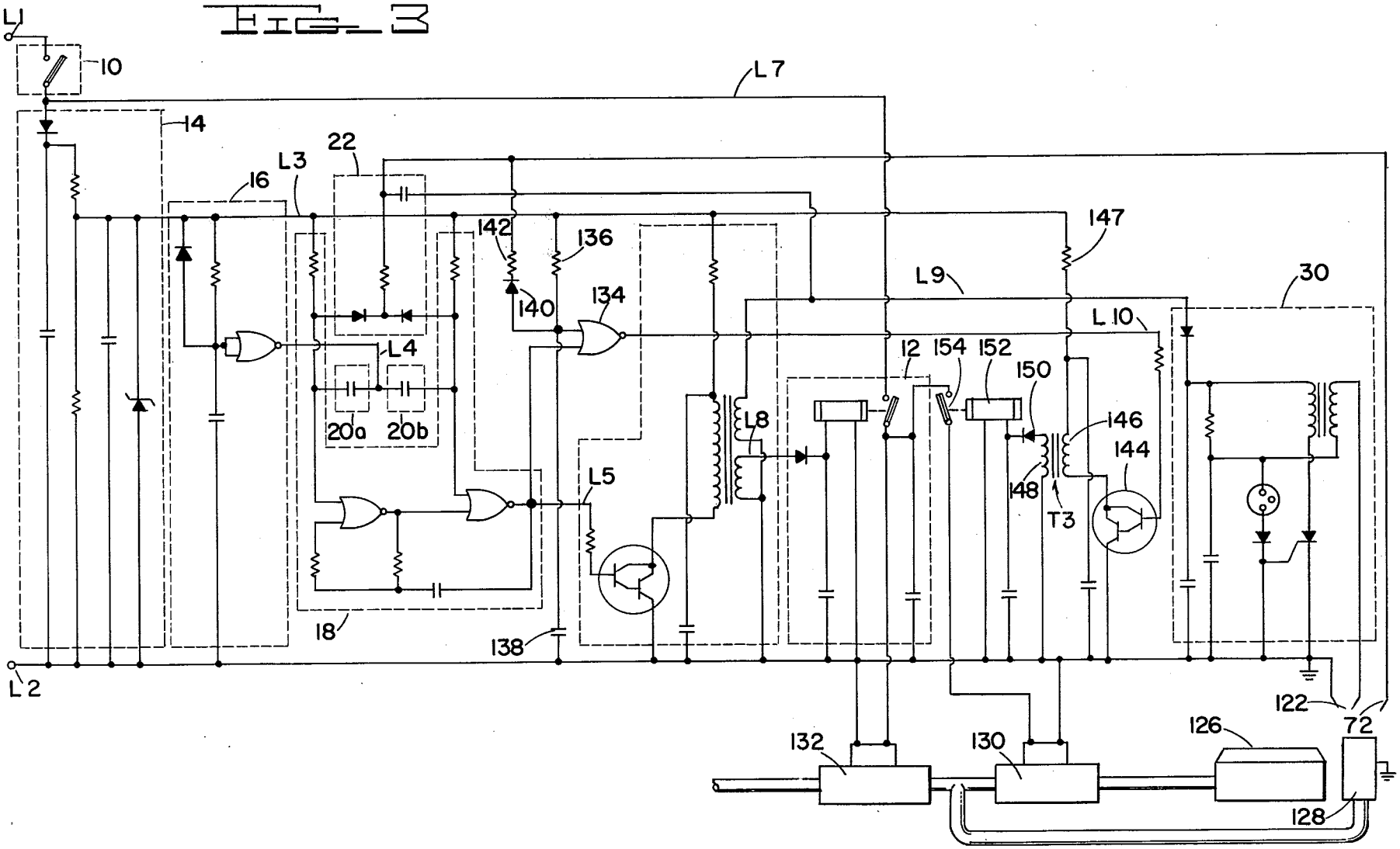
FIG. 3 is a detailed schematic of a pilot relight ignition system in accordance with the present invention.

More specifically, in FIG. 3 the circuits which are essentially the same as in FIG. 2, have been enclosed in dotted lines and have been given the same reference numerals. In addition, in FIG. 3, the main burner is identified as reference numeral 126, the pilot burner as reference numeral 128, the electrically operated main burner valve is identified as reference numeral 130 and the electrically operated pilot valve is identified by reference numeral 132. The pilot relight system disclosed in FIG. 3 additionally includes a NOR gate 134 having one input connected to the oscillator output on line L5 and another input connected to the junction of a resistor 136 and a capacitor 138 serially connected across lines L3 and L2. Also connected to the other input of NOR gate 134 is the anode of a solid state diode 140 which is connected to the flame sensing rod 72 through a current limiting resistor 142. Thus, the output of gate 134 on line L10 is normally low, except when a flame is sensed it oscillates in the same manner as the oscillator. The output of gate 134 is applied to a second voltage converter including a solid state switch 144 and a third transformer T3. The primary winding 146 of transformer T3 is connected in series with a voltage reducing resistor 147 and solid state switch 144 across lines L3 and L2. Secondary winding 148 of transformer T3 is connected in series with a diode 150 and a relay coil 152 which actuates normally open single pole single throw switch contacts 154 which act to connect the electrical operator of the electrically operated main valve 130 in series with the switch contacts of the operator for pilot valve 132. Thus, the electrically operated main valve 130 is actuated when a high signal on line L10 is present and electrically operated pilot valve 132 has been previously actuated.

The invention has been disclosed in two different embodiments which have been used for exemplary purposes only. It is intended that the scope of the invention be determined by the claims.

What is claimed is:

1. A fuel ignition system for fuel burning apparatus having a fuel burner, fuel control means operative when electrically energized to supply fuel to the fuel burner, ignition electrode means for igniting fuel flowing from the fuel burner, flame sensor means including flame electrode means providing an air gap arranged to be bridged by a flame emitted from the fuel burner for conducting flame rectified current when a flame is present at the fuel burner, and operating control means for supplying electrical energy to the fuel ignition system upon a need for operation of the fuel burning apparatus; said fuel ignition system comprising:

an astable oscillator having an output and providing low frequency output pulses at said output, said oscillator including at least one logic gate which has a high impedance inhibit input and which is effective to cause oscillating operation of the oscillator to stop when said inhibit input is energized by a voltage in excess of a predetermined value;

a timing circuit including capacitance means connected across the inhibit input of said logic gate and operable to charge said capacitance means to a voltage exceeding said predetermined value after a predetermined time interval;

switching means responsive to the output pulses of said oscillator to effect energization of said fuel valve means;

voltage converter means operable in response to the output pulses of said oscillator for converting electrical energy supplied by said operating control means to an alternating current output voltage;

spark generating means energized by the alternating current output voltage of said voltage converter means to supply ignition sparks to said ignition electrode means for igniting fuel supplied to said burner to establish a flame;

circuit means for applying the alternating current output voltage of said voltage converter means to said flame sensor means to establish the conduction of flame rectified current through flame bridging said air gap when flame is emitted from said burner;

and a current bypass circuit for connecting said flame electrode means across said capacitance means and operable upon the conduction of flame rectified current through flame bridging said air gap to preclude charging of said capacitance means to a voltage exceeding said predetermined value.

2. The fuel ignition system according to claim 1 wherein said astable oscillator is a free running multivibrator; and said multivibrator comprises said one logic gate and a second logic gate intercoupled by time constant means.

3. The fuel ignition system according to claim 2 wherein each of said logic gates has two inputs and an output; the output of the said one logic gate is connected to a first input of the second logic gate; said time constant means includes a resistor and a capacitor in series connection between the output of said one logic gate and the output of the second logic gate; the junction of the resistor and the capacitor being connected to a first input of said one logic gate; the output of the second logic gate being said output of the oscillator; and the second input of said one logic gate being said inhibit input of said one logic gate.

4. The fuel ignition system according to claim 3 wherein the second input of the second logic gate is a second high impedance inhibit input; said second logic gate is effective to cause oscillating operation of said oscillator to stop when said second inhibit input is energized by a voltage in excess of said predetermined value; and said capacitance means of said timing circuit is connected across said second inhibit input.

5. The fuel ignition system according to claim 4 wherein said capacitance means comprises a first capacitor and a second capacitor connected respectively across said first and second inhibit inputs; said current bypass circuit comprises resistance means and first and second diodes which have their anodes connected through said resistance means to said flame electrode means; and the cathodes of said first and second diodes are connected respectively to said first and second capacitors.

6. The fuel ignition system according to claim 5 further including a purge timer, wherein said purge timer comprises:

a charging circuit including a resistor and a capacitor in series with one another; and an electronic switching gate electrically connected to said charging circuit and responsive to the voltage levels in said charging circuit to switch between first and second levels.

7. The fuel ignition system according to claim 1, wherein said fuel burner is a pilot burner.

8. The fuel ignition system according to claim 7 further including a main burner and main burner fuel control means operative when electrically energized to supply fuel to said main fuel burner.

9. The fuel ignition system as claimed in claim 8 wherein said main burner fuel control means comprises:

an electronic switching gate including a first input connected to the output of said oscillator and an enable input connected to the output of said flame sensor means; and second voltage converter means operable in response to the output pulses of said electronic switching gate for converting electrical energy supplied by said operating control means to an alternating current output voltage.

* * * * *